US007757413B2

(12) United States Patent
Anderson

(10) Patent No.: US 7,757,413 B2
(45) Date of Patent: Jul. 20, 2010

(54) MAGNETIC SWIVEL SPORTS SHOES

(76) Inventor: Allen J. Anderson, 21220 Harrow Ave. N., Forest Lake, MN (US) 55025

( * ) Notice: Subject to any disclaimer, the term of this patent is extended or adjusted under 35 U.S.C. 154(b) by 0 days.

(21) Appl. No.: 12/004,996

(22) Filed: Dec. 26, 2007

(65) Prior Publication Data

US 2009/0165336 A1 Jul. 2, 2009

(51) Int. Cl.
*A43B 5/00* (2006.01)
*A43C 15/02* (2006.01)

(52) U.S. Cl. ..... 36/134; 36/127; 36/128

(58) Field of Classification Search ..... 36/134, 36/127, 128, 39
See application file for complete search history.

(56) References Cited

U.S. PATENT DOCUMENTS

| | | | | | |
|---|---|---|---|---|---|
| 3,081,562 | A | | 3/1963 | Oakley | |
| 3,271,885 | A | * | 9/1966 | McAuliffe | 36/114 |
| 3,354,561 | A | * | 11/1967 | Cameron | 36/134 |
| 3,680,231 | A | | 8/1972 | Dymond | |
| 3,707,047 | A | | 12/1972 | Nedwick | |
| 3,739,497 | A | * | 6/1973 | Cameron | 36/134 |
| 3,744,160 | A | | 7/1973 | Dymond | |
| 3,816,945 | A | | 6/1974 | Egtvedt | |
| 3,824,710 | A | | 7/1974 | Egtvedt | |
| 4,670,997 | A | | 6/1987 | Beekman | |
| D296,838 | S | | 7/1988 | Diaz | |
| 5,012,597 | A | | 5/1991 | Thomasson | |
| 5,199,192 | A | | 4/1993 | Kilgore et al. | |
| 5,363,573 | A | | 11/1994 | Kilgore et al. | |
| 5,392,537 | A | | 2/1995 | Goldberg | |
| 5,566,478 | A | * | 10/1996 | Forrester | 36/134 |
| 5,682,689 | A | | 11/1997 | Walker et al. | |
| 5,692,323 | A | | 12/1997 | Goldberg | |
| 6,035,559 | A | | 3/2000 | Freed et al. | |
| 6,299,192 | B1 | * | 10/2001 | Bryce | 280/613 |
| 6,829,848 | B2 | | 12/2004 | Gallegos | |
| 7,392,604 | B2 | * | 7/2008 | Greene et al. | 36/97 |

* cited by examiner

*Primary Examiner*—Ted Kavanaugh

(57) ABSTRACT

A shoe that relates to safety of the participants' when sports shoes with cleats are employed, e.g. golf, football, and soccer. Knee, ankle, & hip injuries are brought about by abrupt leg turns after the foot is planted and the participant's knee continues to move in a separate direction.

A principle objective of the present invention is also to enhance the participants' performance. The primary objective, however, is to minimize the frequency and/or seriousness of knee, ankle, and hip injuries brought about by knee and leg turns after the foot is planted on the playing surface. This invention will permit the foot to rotate under magnetic control when enough pressure is exerted by the participant's body.

1 Claim, 1 Drawing Sheet

MAGNETIC SWIVEL SPORTS SHOES

BACKGROUND OF THE INVENTION

The invention relates to safety of the participants' when sports shoes with cleats are employed, e.g. golf, football, and soccer. Knee, ankle, & hip injuries are brought about by abrupt leg turns after the foot is planted and the participant's knee continues to move in a separate direction.

Most sport shoes are structured toward a firm implanting of the foot into the playing surface to preclude the participants slipping. The ultimate purpose of the sports shoe is to enhance the participant's performance.

A principle objective of the present invention is also to enhance the participants' performance. The primary objective, however, is to minimize the frequency and/or seriousness of knee, ankle, and hip injuries brought about by knee and leg turns after the foot is planted on the playing surface. This invention will permit the foot to rotate when enough pressure is exerted by the participant's body. An analogy can be made to ice hockey where the shoe can rotate since the shoe is not implanted into the ice.

A derivative of this invention is that it may enhance a participants' performance by permitting more flexible turns, e.g. the likely enhancement of a golfer's ability to move effortlessly will lengthen their shots.

SUMMARY OF INVENTION

This invention will permit the user to avoid or reduce potential knee injuries by reducing the resistance brought about by abrupt leg turns when shoe cleats are implanted. Further, this invention will likely enhance a golfer's ability to lengthen their shots.

Technical Features of Magnetic Shoes:

1. A circular magnetic plate with cleats (the assembly) would attach to the shoe or sports shoe which would rotate in a circular motion up to 360 degrees. Magnetized friction discs could be substituted for an actual magnet with use of a thin metal plate.
2. The assembly would attach to a metal plate built into the shoe (This would cover the ball area of the foot). A heel without cleats would be necessary to preclude interruption of the user's rotation.
3. The assembly can be adjusted to a desired degree of rotation by changing the magnetic strength of the assembly.
4. The cleats would screw into the magnetic swivel plate to create the assembly.
5. The sports shoe would have a circular hole in the outer tier of the sole. This would permit the assembly to attach to the shoe through its magnetic attraction to the metal plate in the shoe and conform to the bottom of the sole of the shoe.
6. The heel does not include an assembly or cleats. A smooth heel is provided to preclude competing rotation with the foot assembly. Further, a slightly elevated and tapered (from back to front) heel is provided to remind the athlete to keep his foot pressure on the ball of his foot.

DESCRIPTION OF THE EMBODIMENT

Figure 1:
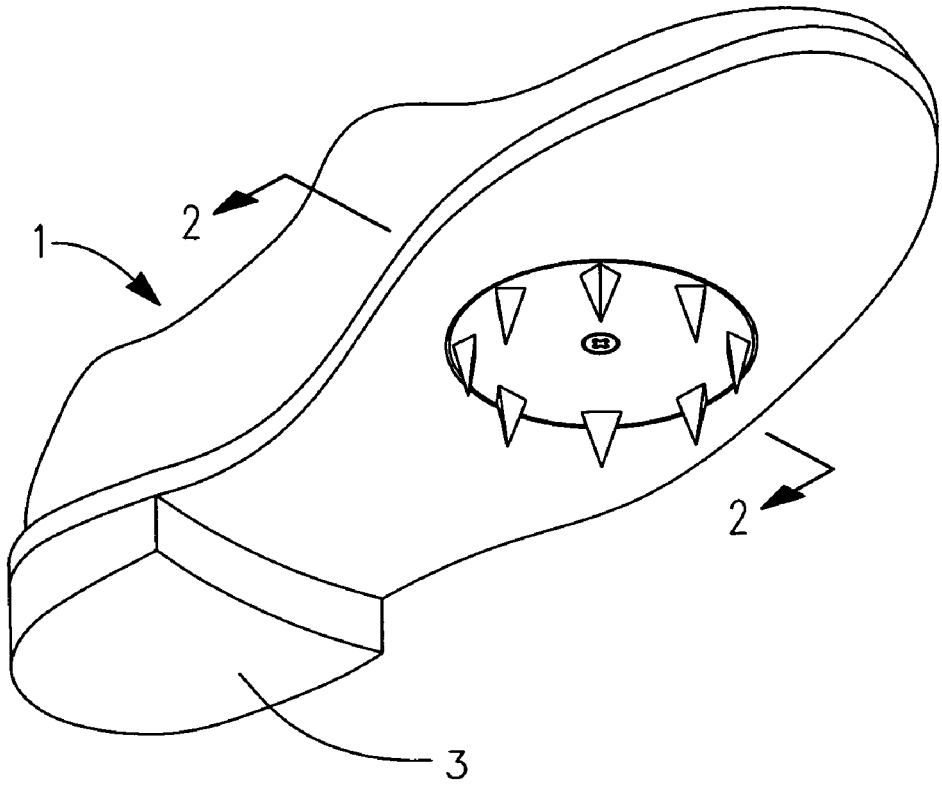
FIG. 1 is a bottom view and a partial side view of the present invention.
Figure 2:
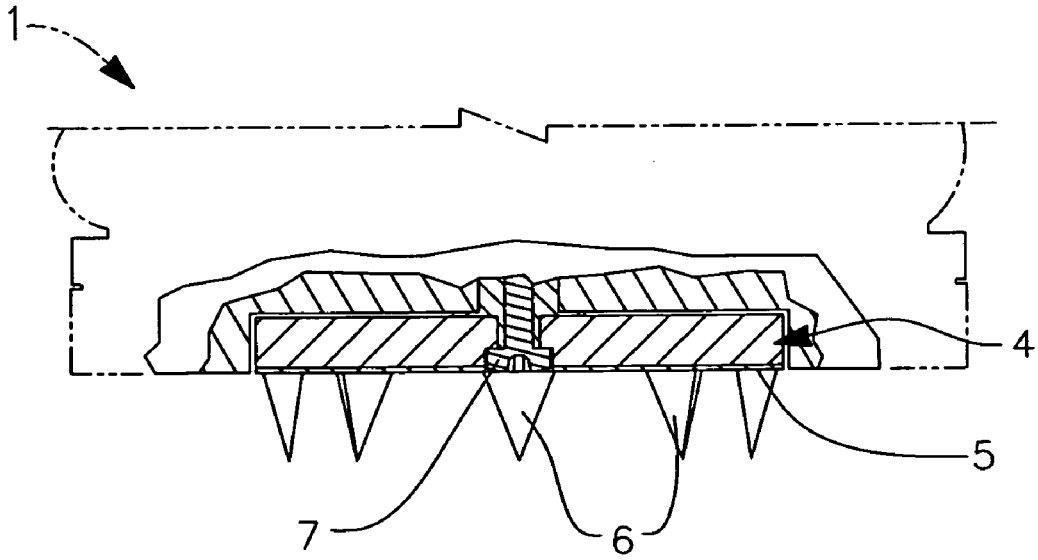
FIG. 2 is a side view of the present invention showing the magnetic insert assembly with cleats.

Referring now to the drawings in detail, the reference number 1 represents a magnetic swivel athletic shoe.

Reference number 2 shows a steel plate (thin & light) that is imbedded between the two layers of the shoe's sole.

Reference number 3 shows the slightly tapered smooth heel. This is employed to permit the user to put his or her foot pressure on the ball of their foot and not to restrict lateral or transverse sliding.

Reference number 4 shows the assembly that inserts or fits into a circular depression of the sole of the shoe and which contains the magnet which is attracted to the steel plate in the shoe.

Reference number 5 shows the thin aluminum plate that affixes to the outer side of the magnetic plate, which is utilized to preclude rust (optional).

Reference number 6 shows the cleats that screw into and through the aluminum plate to permit their being screwed into the magnetic plate.

Reference number 7 is a locking nut with a threaded opening that is contained in the sole of the shoe. The screw or pin is employed to hold the assembly in place. This is an optional add on to the invention as the magnetic attraction of the assembly to the steel plate in the shoe is believed to be adequate to keep the assembly in place.

It should be evident that during a sudden turning force by the foot the assembly, will cause the shoe to rotate about the cleat unit when the cleats are holding firmly against the ground.

This patent differs from prior relevant patents in the following respects:

1. The rotation of the assembly can be controlled by the strength of the magnets. Prior art assumes "one size fits all", i.e. the control is the same without regard to the user's size, weight, and desire.
2. The assembly will conform to the bottom of the sole of the shoe without increasing the normal golf shoe sole thickness and appearance.
3. The assembly attaches to the sole of the shoe through magnetic attraction only. However, an optional screw into the shoe device is offered.
4. The assembly and the cleats can be easily and conveniently replaced.
5. The size and weight of the assembly appears to be significantly less.
6. The heel does not include cleats. A smooth heel is provided for to preclude competing rotation with the foot assembly. Further, a slightly elevated and tapered (from back to front) heel is provided to remind the athlete to keep his foot pressure on the ball of his foot.

The invention claimed is:

1. A magnetic swivel athletic shoe comprising:

a shoe sole having a circular hole located on a bottom surface of the sole, a metal frame located in the circular hole and fixedly attached to the shoe, an assembly comprising a circular unit with cleats protruding from a bottom surface of the unit, the assembly rotatably located in the hole and within the frame, the unit capable of rotating up to 360 degrees and, a magnetic resistance system effective for creating a magnetic force between the frame and the assembly, wherein (i) the assembly will rotate relative to the frame when enough tortional force is exerted on the unit to overcome the magnetic force, and (ii) the strength of the magnetic force can be adjusted.

* * * * *